US008424443B2

(12) United States Patent
Gonzalez

(10) Patent No.: US 8,424,443 B2
(45) Date of Patent: Apr. 23, 2013

(54) VENTED ARMOR V STRUCTURE

(75) Inventor: Rene' G. Gonzalez, Southfield, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 235 days.

(21) Appl. No.: 13/017,488

(22) Filed: Jan. 31, 2011

(65) Prior Publication Data

US 2012/0192706 A1 Aug. 2, 2012

(51) Int. Cl.
*F41H 5/04* (2006.01)

(52) U.S. Cl.
USPC ..... 89/36.02; 89/36.08; 296/187.07

(58) Field of Classification Search ..... 89/36.01, 89/36.02, 36.07, 36.08, 36.09; 296/187.07, 296/187.08, 64, 190.03, 190.01, 193.04
See application file for complete search history.

(56) References Cited

U.S. PATENT DOCUMENTS

| | | | | |
|---|---|---|---|---|
| 1,026,207 | A | | 5/1912 | Johnson |
| 1,761,095 | A | | 6/1930 | Spottswood |
| 1,899,735 | A | | 2/1933 | McClintock |
| 2,392,215 | A | | 1/1946 | Abrams et al. |
| 3,351,374 | A | | 11/1967 | Forsyth et al. |
| 3,450,254 | A | | 6/1969 | Miles |
| 3,604,374 | A | | 9/1971 | Matson et al. |
| 3,677,364 | A | | 7/1972 | Pawlina |
| 3,736,838 | A | * | 6/1973 | Butterweck et al. ..... 89/36.02 |
| 4,055,247 | A | | 10/1977 | Benedick et al. |
| 4,083,694 | A | | 4/1978 | Takeda et al. |
| 4,186,817 | A | | 2/1980 | Bauer |
| 4,323,000 | A | | 4/1982 | Dennis et al. |
| 4,326,468 | A | * | 4/1982 | King et al. ..... 109/49.5 |
| 4,347,796 | A | | 9/1982 | King et al. |
| 4,536,982 | A | | 8/1985 | Bredbury et al. |
| 4,663,875 | A | | 5/1987 | Tatro |
| 4,727,789 | A | | 3/1988 | Katsanis et al. |
| 4,965,138 | A | | 10/1990 | Gonzalez |
| 4,981,067 | A | | 1/1991 | Kingery |
| 5,007,326 | A | | 4/1991 | Gooch, Jr. et al. |
| 5,014,593 | A | | 5/1991 | Auyer et al. |
| 5,149,910 | A | | 9/1992 | McKee |
| 5,628,682 | A | | 5/1997 | Gonzalez |
| 5,961,182 | A | | 10/1999 | Dellanno |
| 6,099,042 | A | | 8/2000 | Cook et al. |
| 6,405,630 | B1 | | 6/2002 | Gonzalez |
| 6,557,929 | B2 | | 5/2003 | Fox et al. |
| 7,000,550 | B1 | | 2/2006 | Mandall |
| 7,270,045 | B1 | | 9/2007 | Gonzalez |

(Continued)

*Primary Examiner* — Gabriel Klein
(74) *Attorney, Agent, or Firm* — Thomas W. Saur; David L. Kuhn; Luis Miguel Acosta

(57) ABSTRACT

An armor structure for a vehicle underbody. The armor structure includes an inner plate that is mounted proximate to the vehicle underbody, the inner plate having a plurality of first openings; and an outer plate that is mounted distal to the vehicle underbody, the outer plate having a plurality of second openings. The inner plate and the outer plate are substantially parallel and separated by a spacing. The inner plate and the outer plate each have substantially equal V bends at an obtuse angle, and the V bends in the inner plate and the outer plate are aligned. The first openings and the second openings are (i) aligned across the spacing from each other, and (ii) substantially equal in area. When an underbody blast event is encountered by the vehicle, the outer plate is forced towards, and substantially against the inner plate such that there is no longer fluid communication through the first openings.

14 Claims, 3 Drawing Sheets

U.S. PATENT DOCUMENTS

| | | | | |
|---|---|---|---|---|
| 7,350,451 | B2 | 4/2008 | Barisciano, Jr. | |
| 7,685,924 | B2 * | 3/2010 | Barbe et al. | 89/36.09 |
| 8,146,477 | B2 * | 4/2012 | Joynt | 89/36.08 |
| 2008/0066613 | A1 * | 3/2008 | Mills et al. | 89/36.09 |
| 2011/0138994 | A1 * | 6/2011 | Joynt et al. | 89/36.08 |
| 2012/0174767 | A1 * | 7/2012 | Naroditsky et al. | 89/36.08 |

* cited by examiner

VENTED ARMOR V STRUCTURE

GOVERNMENT INTEREST

The invention described here may be made, used and licensed by and for the U.S. Government for governmental purposes without paying royalty to me.

BACKGROUND OF THE INVENTION

1. Field of the Invention

The present invention generally relates to a vented armor V structure.

2. Background Art

Recently, a class of military vehicles known as Mine Resistant Ambush Protected (MRAP) vehicles has become popular due to the protection which is provided against mines, improvised explosive devices (IEDs), and the like. The most salient feature of the MRAP is the "V" shaped lower hull armor which has proven effective at deflecting the blast of under-vehicle explosions. There have been numerous efforts to retrofit "V" shaped blast shields on vehicles which were not designed to accept such protection. In some cases the added protection is well tolerated by the host vehicle, in other cases automotive problems occurred. The primary source of automotive problems derives from the added on protective "V" armor structure that prevents airflow from the engine compartment and around the transmission. The resulting inadequate heat dissipation can cause overheating of the automotive components.

The use of protective underbody structures that are vented to reduce heat effects is taught by such references as U.S. Pat. No. 6,099,042. An armor system having inner and outer perforated armor layers with various shapes of perforations and with filler between the layers is shown and described in, for example, U.S. Pat. Nos. 4,965,138 and 5,014,593. The use of foam filler, in particular, between layers of armor is taught by U.S. Pat. Nos. 3,351,374 and 5,014,593. Implementation of bendable tabs to produce energy absorption between inner and outer layers of both flat and curve shaped surfaces is taught in U.S. Pat. No. 6,557,929. Closing off the venting effect of holes with flap like elements in response to force against the flap elements is taught by U.S. Pat. No. 3,450,254. Additional background references may include U.S. Pat. Nos. 1,026,207; 1,761,095; 1,899,735; 2,392,215; 3,604,374; 4,055,247; 4,083,694; 4,186,817; 4,323,000; 4,347,796; 4,536,982; 4,663,875; 4,727,789; 4,981,067; 5,007,326; 5,149,910; 5,628,682; 5,961,182; 6,405,630; 7,000,550; 7,270,045; and 7,350,451. However, a deficiency of typical conventional underbody armor structures is a failure to provide a combination of adequate heat dissipation and adequate protection from IEDs and mines.

Thus, there exists a need and an opportunity for an improved vented armor structure, particularly V-shaped armor structure for underbody implementation. Such an improved system may overcome one or more of the deficiencies of the conventional approaches.

SUMMARY OF THE INVENTION

In accordance with the present invention, to mitigate potential overheating a "vented" "V" underbody vehicle armor structure can be implemented which allows air to flow through the "V" during normal operation while providing protection from underbody blast events. The "V" armor generally comprises two layers of armor structure that are spaced apart: a thick inner "V" structure element intended to withstand the blast loads, and a thin outer "V" structure element intended to collapse during a blast. Both inner and outer structures may be perforated, with openings in corresponding locations such that a passageway might be easily constructed from the inner to the outer structural layers of armor.

To reduce or prevent accumulation of debris in the space between the layers, a tube may be implemented between complementary openings in the two layers. The tubes may provide a duct type path for heat to escape from the vehicle.

Between the inner and outer layer a valve subsystem may be implemented. The valve subsystem is generally rapidly closed by the pressure generated by an explosion. In simple form, the valve subsystem can be flaps of material which are forced over the holes in the inner structure by the movement of the outer structure. The valve subsystem closing action will generally reduce or prevent most of the high pressure gasses generated by the under-vehicle explosion from bypassing the inner "V" and thus provide significant blast protection; well beyond the protection that the perforated structure would provide without rapidly closing valve subsystem.

The space between the inner and outer "V" structures may be filled with structural foam, honeycomb, or similar material which will form a continuous passage between the inner and outer perforations. Under normal, pre-blast event operating conditions, the foam "ducting" may conduct gasses (i.e., heat) efficiently from the inside of the inner "V" to the bottom of the outer "V". The foam (or other filler) is generally compressible, and during a blast event will generally not interfere with the closing function of the valve subsystem. The filler also may prevent debris such as soil or mud from becoming lodged between inner and outer "V" structures. Buildup of such debris materials would generally add weight to the vehicle, and could result in preventing the valves from functioning properly.

Accordingly, the present invention may provide an improved vented armor structure, particularly a V-shaped armor structure for underbody implementation.

According to the present invention, an armor structure for a vehicle underbody may be provided. The armor structure generally includes an inner plate that is mounted proximate to the vehicle underbody, the inner plate having a plurality of first openings; and an outer plate that is mounted distal to the vehicle underbody, the outer plate having a plurality of second openings. The inner plate and the outer plate are generally substantially parallel and separated by a spacing. The inner plate and the outer plate each may have substantially equal V bends at an obtuse angle, and the V bends in the inner plate and the outer plate are generally aligned. The first openings and the second openings are (i) aligned across the spacing from each other, and (ii) substantially equal in area. The first openings and the second openings provide fluid communication through the armor structure. When an underbody blast event is encountered by the vehicle underbody, the outer plate may be forced towards, and substantially against the inner plate such that there is no longer fluid communication through the first openings.

The inner plate is generally thicker than the outer plate.

The inner plate may be at least twice as thick as the outer plate.

The inner plate may be at least five times as thick as the outer plate.

The armor structure may further include:

a plurality of valves, each valve having a bendable hinge, the bendable hinge fastened on the side of the inner plate that faces the outer plate; and each of the valves is positioned and aligned with respect to one of the first openings such that, when the underbody blast event is encountered, the outer plate will push against the valve, the hinge will bend, and the valve will block the first opening such that there is no longer fluid communication through the first opening. The number of valves may be at least equal to the number of first openings.

The armor structure may further include:

a plurality of ducts equal to the number of first openings, and the ducts are implemented to connect each of the first openings and the second openings that are aligned across the spacing from each other, wherein the ducts are longer than the spacing such that there is overlap into the first openings and the second openings and the ducts are sized to snugly fit into the first openings and the second openings; and the walls of the ducts are made of a thin, flexible material that will collapse when the underbody blast event is encountered such that fluid communication via the first opening is reduced or prevented.

The armor structure may further include:

a filling in the spacing, and the filling includes a plurality of continuous passages that are implemented to connect each of the first openings and the second openings that are aligned across the spacing from each other, the filling is compressible or crushable, and during the underbody blast event, the filling is compressed or crushed.

The valves may be implemented as at least one of a tab valve and an accordion valve.

The armor structure may further include:

a filling in the spacing exclusive of inside of the ducts; and the filling is compressible or crushable, and during the underbody blast event, the filling is compressed or crushed.

The armor structure may further include:

a plurality of valves, each valve having a bendable hinge, the bendable hinge fastened on the side of the inner plate that faces the outer plate; and each of the valves is positioned and aligned with respect to one of the ducts such that, when the underbody blast event is encountered, the outer plate will push against the valve, the hinge will bend, and the valve will block the duct such that there is no longer fluid communication through the first opening.

Further, according to the present invention, a method of protecting a vehicle underbody may be provided. The method generally includes mounting an inner plate proximate to the vehicle underbody, the inner plate having a plurality of first openings; and mounting an outer plate distal to the vehicle underbody, the outer plate having a plurality of second openings, to form an armor structure. The inner plate and the outer plate are generally substantially parallel and separated by a spacing. The inner plate and the outer plate may each have substantially equal V bends at an obtuse angle, and the V bends in the inner plate and the outer plate are generally aligned. The first openings and the second openings are generally (i) aligned across the spacing from each other, and (ii) substantially equal in area. The first openings and the second openings may provide fluid communication through the armor structure. When an underbody blast event is encountered by the vehicle underbody, the outer plate is generally forced towards, and substantially against the inner plate such that there is no longer fluid communication through the first openings.

The inner plate is generally thicker than the outer plate.

The inner plate may be at least twice as thick as the outer plate.

The inner plate may be at least five times as thick as the outer plate.

The armor structure may further include:

a plurality of valves, each valve having a bendable hinge, the bendable hinge fastened on the side of the inner plate that faces the outer plate; and each of the valves is positioned and aligned with respect to one of the first openings such that, when the underbody blast event is encountered, the outer plate will push against the valve, the hinge will bend, and the valve will block the first opening such that there is no longer fluid communication through the first opening. The number of valves may be at least equal to the number of first openings.

The armor structure may further include:

a plurality of ducts equal to the number of first openings, and the ducts are implemented to connect each of the first openings and the second openings that are aligned across the spacing from each other, wherein the ducts are longer than the spacing such that there is overlap into the first openings and the second openings and the ducts are sized to snugly fit into the first openings and the second openings; and the walls of the ducts are made of a thin, flexible material that will collapse when the underbody blast event is encountered such that fluid communication via the first opening is reduced or prevented.

The armor structure may further include:

a filling in the spacing, and the filling includes a plurality of continuous passages that are implemented to connect each of the first openings and the second openings that are aligned across the spacing from each other, the filling is compressible or crushable, and during the underbody blast event, the filling is compressed or crushed.

The valves may be implemented as at least one of a tab valve and an accordion valve.

The armor structure may further include:

a filling in the spacing exclusive of inside of the ducts; and the filling is compressible or crushable, and during the underbody blast event, the filling is compressed or crushed.

The armor structure may further include:

a plurality of valves, each valve having a bendable hinge, the bendable hinge fastened on the side of the inner plate that faces the outer plate; and each of the valves is positioned and aligned with respect to one of the ducts such that, when the underbody blast event is encountered, the outer plate will push against the valve, the hinge will bend, and the valve will block the duct such that there is no longer fluid communication through the first opening.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
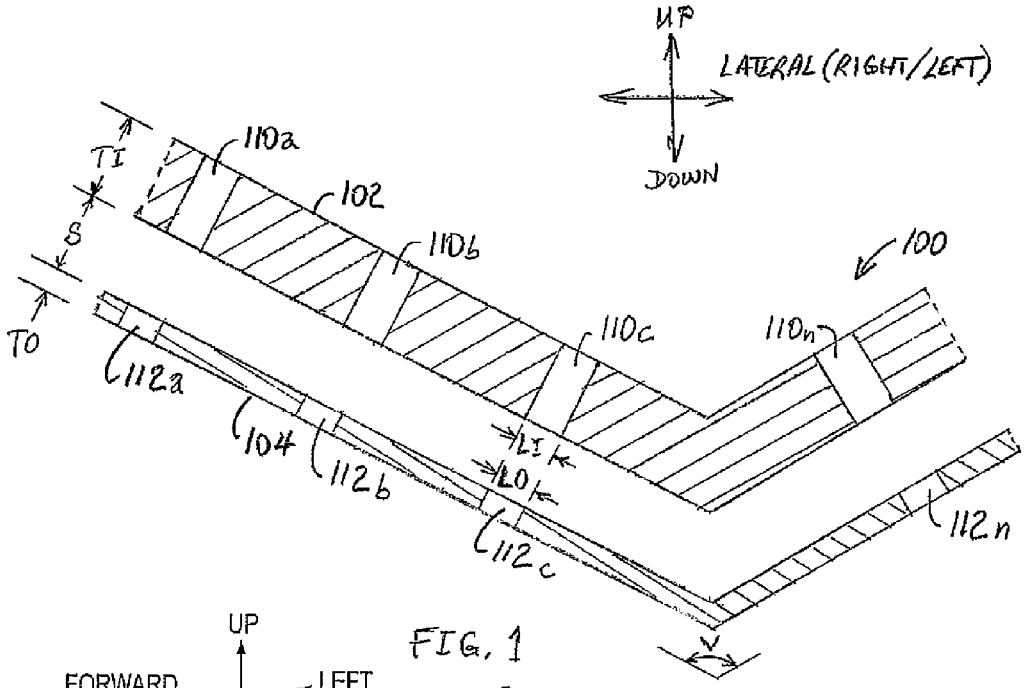
FIG. 1 is a sectional view of an embodiment of an armor structure of the present invention.

Definitions and Terminology:

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, dimension, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

For a vehicle, and a system mounted on or used in connection with the vehicle, forward/reverse (longitudinal) and vertical (up/down) directions are generally relative to the vehicle and system as typically operated (e.g., when the vehicle is operated with the respective powertrain in a forward/reverse mode). As such, lateral (left/right) directions are generally perpendicular to the longitudinal/vertical plane, and are referenced from a vehicle operator (e.g., driver) perspective. A first direction (e.g., forward) and a second direction (e.g., rearward or reverse) where the second direction substantially, but not necessarily wholly, opposes the first direction are also generally or used in connection with the vehicle. Referenced directions are generally as shown on FIGS. 1 and 2 unless otherwise noted. Likewise, elements located (mounted, positioned, placed, installed, etc.) on, near, or proximate to the vehicle body are generally referred to as "inner", while elements that are distal or more remote to the vehicle body are generally referred to as "outer", unless otherwise noted. As such, inner elements are generally closer to the vehicle body than outer elements.

With reference to the Figures, the preferred embodiments of the present invention will now be described in detail. Generally, the present invention provides an improved system and an improved method for a vented armor structure. While described in particular detail in connection with a "V" shaped underbody armor structure that is generally retrofitted to a vehicle, the present invention may be implemented in connection with any application where a combination of heat dissipative venting and armor protection, particularly protection from blast related effects, is desired, e.g., as an original equipment armor structure.

In accordance with the present invention, to mitigate potential overheating a "vented" "V" can be implemented which allows air to flow through the "V" during normal operation. This "V" generally comprises a thick inner "V" structure intended to withstand the blast loads and a thin outer "V" structure intended to collapse during a blast. Both inner and outer structures are perforated, with openings in corresponding locations such that a passage way might be easily constructed from the inner to the outer. In one or more embodiments, between the inner and outer layer a valve which is rapidly closed by the pressure generated by an explosion may be implemented. In simple form the valve can be flaps of material which are forced over the holes in the inner structure by the movement of the outer structure. This action will generally prevent most of the high pressure gasses generated by the under-vehicle explosion from bypassing the inner "V" and thus provide significant blast protection; well beyond what the perforated structure would provide without rapidly closing valves.

In one or more other embodiments, the space between the inner and outer "V" structures may be filled with honeycomb, structural foam or similar material which will form a continuous passage ("ducting") between the inner and outer perforations. This "ducting" will conduct gasses efficiently from the inside of the inner "V" to the bottom of the outer "V". The filler material is generally compressible, and during a blast will generally not interfere with the closing function of the valve mechanism. The filler material may also reduce or prevent debris such as soil or mud from becoming lodged between inner and outer "V" structures. Buildup of such debris would generally add weight to the vehicle and could result in preventing the valves from functioning properly.

In one or more other embodiments, a duct (e.g., pipe, tube, cylinder, and the like) may be implemented to connect the complementary (i.e., matching) perforations in the inner and outer structures. The duct may also reduce or prevent debris such as soil or mud from becoming lodged between inner and outer "V" structures.

Figure 2:
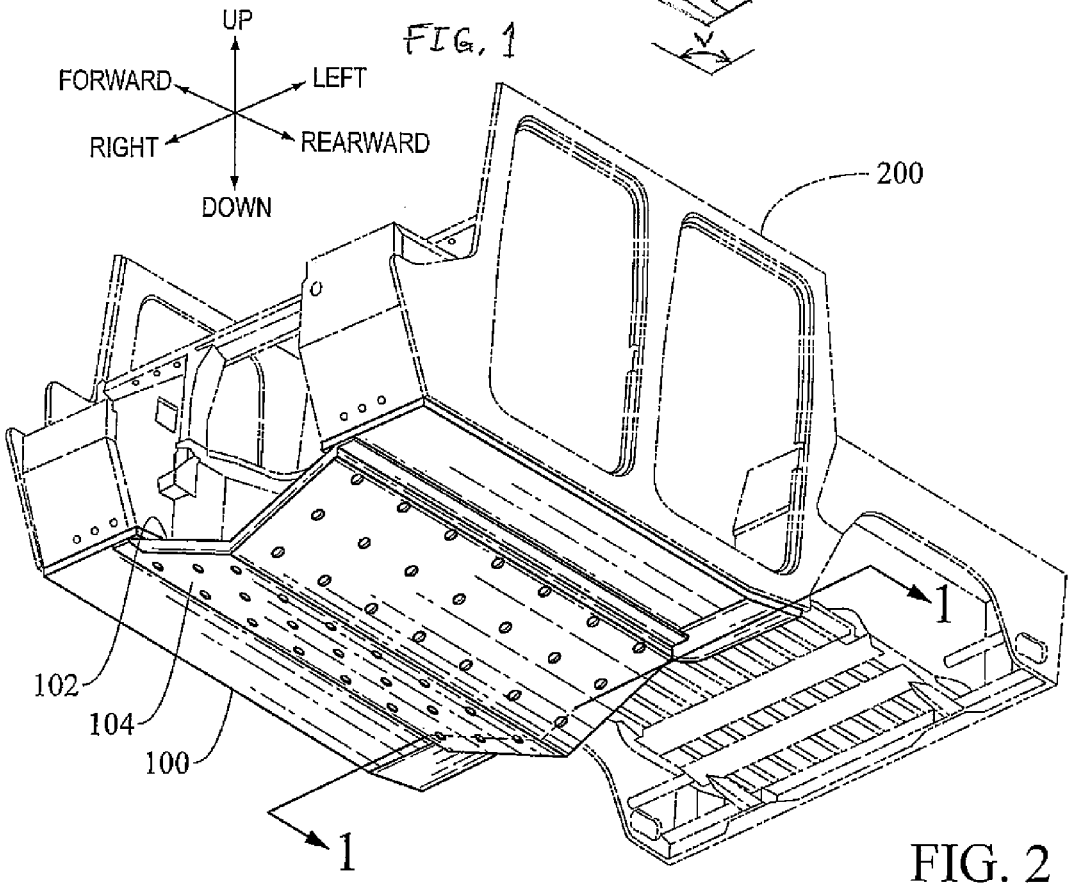
FIG. 2 is an isometric view of the armor structure of FIG. 1 as implemented in connection with a vehicle.

Referring to FIG. 1, a sectional view of an armor structure (or system) 100 taken at the line 1 of FIG. 2 is shown. The armor 100 generally comprises an inner (i.e., inner) plate 102 and an outer (i.e., second) plate 104. The armor 100 may be implemented as a double walled, vented, V-shaped underbody armor structure. The view of the armor 100 that is illustrated in FIG. 1 depicts the armor 100 before a blast event is encountered.

The inner plate 102 and the outer plate 104 are generally substantially parallel, separated by spacing, S; and each having a bend at an obtuse angle, V, and the V bends in the inner plate 102 and the outer plate 104 are generally aligned. The inner plate 102 may have a thickness, TI; and the outer plate 104 may have a thickness, TO. The inner plate 102 thickness, TI, is generally larger (greater) than the outer plate 104 thickness, TO. In one embodiment, the inner plate 102 thickness, TI, is at least twice as large as the outer plate 104 thickness, TO. In another embodiment, the inner plate 102 thickness, TI, is at least five times as large as the outer plate 104 thickness, TO.

The inner plate 102 and the outer plate 104 are generally implemented via structural armor materials such as rolled minor steel, 5083 series aluminum, and the like. However, the inner (first) plate 102 and the outer (second) plate 104 may be implemented using any appropriate materials and combinations of materials to meet the design criteria of a particular application.

The inner (first) plate 102 generally includes a plurality of first openings (e.g., perforations, holes, passages, orifices, apertures, and the like) 110 (e.g., first openings 110*a*-110*n*); and the outer (second) plate 104 generally includes a plurality of second openings 112 (e.g., second openings 112*a*-112*n*). The openings 110*a*-110*n* and the openings 112*a*-112*n* are generally complementary. That is, the openings 110*a*-110*n* and the openings 112*a*-112*n* are generally aligned across the spacing, S, from each other, are equal in number, and may be substantially equal in area and shape. The complementary (matching) openings 110*a*-110*n* and the openings 112*a*-112*n* generally provide fluid communication (e.g., for hot air passage) through the armor 100. The openings 110*a*-110*n* and the openings 112*a*-112*n* are generally implemented having sufficient number and area to provide dissipation of heat that may be generated by one or more devices (e.g., an engine, a transmission, a transfer case, etc.) that is generally located above the upper side of the plate 102 (i.e., above the side of the plate 102 that is opposite the side of the plate 102 that faces the plate 104).

The first opening 110 may have a lateral dimension (e.g., diameter when the opening 110 is circular), LI; and the second opening 112 may have a lateral dimension (e.g., diameter when the opening 112 is circular), LO. In one example, the lateral dimensions LI and LO may be substantially equal. As is known to one of skill in the art, the openings 110 and the openings 112 may be implemented as substantially circular holes, as slots having rectangular or oblong shape, as triangular holes, or as having any appropriate regular or irregular shape to meet the design criteria (e.g., physical layout limitations, heat rejection desired, and the like) of a particular application. The openings 110 and 112 may not necessarily have the same shape; and may not necessarily be equal in number.

Referring to FIG. 2, an isometric view from the left, front, underside of a vehicle 200 (shown in phantom for clarity), where the armor system 100 may be implemented (i.e., mounted, installed, retrofitted, attached, etc.) is illustrated. The inner plate 102 is generally mounted proximate to the underbody of the vehicle 200; and the outer plate 104 is generally mounted distal to the underbody of the vehicle 200. The bend having the angle, V, may be oriented longitudinally with respect to the vehicle 200 as illustrated. However, the angle, V, may be oriented at any appropriate vehicular direction depending on the particular application. In one embodiment, the outer plate 104 may be curved at lateral edges to intersect the vehicle 200, and provide a fastening location. In another embodiment (not shown), a subsystem of standoffs may be implemented to provide fastening and the spacing, S, between the inner plate 102 and the outer plate 104, as would be known to one of skill in the art.

Figure 3:
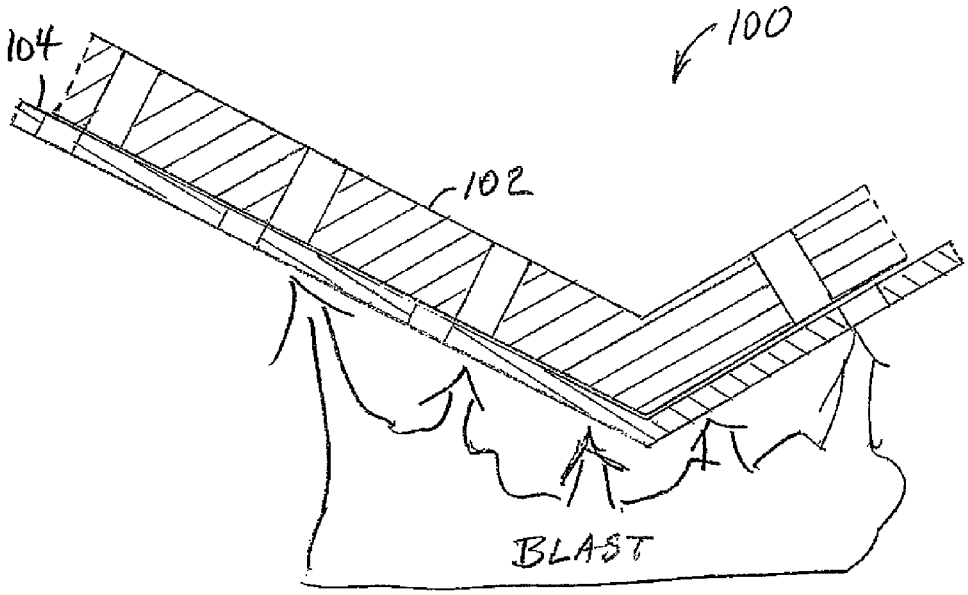
FIG. 3 is a sectional view of the armor structure of FIG. 1 after a blast event has been encountered.

Referring to FIG. 3, a sectional view of the armor system 100 after an underbody blast event (e.g., an underbody mine, improvised explosive device, and the like) has been encountered is illustrated. The blast generally forces at least a portion (section, region, etc.) the outer (second) plate 104 towards, and substantially against, the inner plate 102. The openings 110 and 112 are sized and aligned such that there is no longer fluid communication through the openings 110 in the inner (first) plate 102 (i.e., the ends of the openings 110 that face the outer plate 104 are generally blocked in response to the blast event). The outer (second) plate 104 generally does not substantially change fore-aft position on the vehicle 20 after the underbody blast event is encountered. As such, blast protection is generally provided to the region of the vehicle 200 that is above the plate 102 (i.e., the armor structure 100 generally provides protection to the underbody of the vehicle 200).

Figure 4:
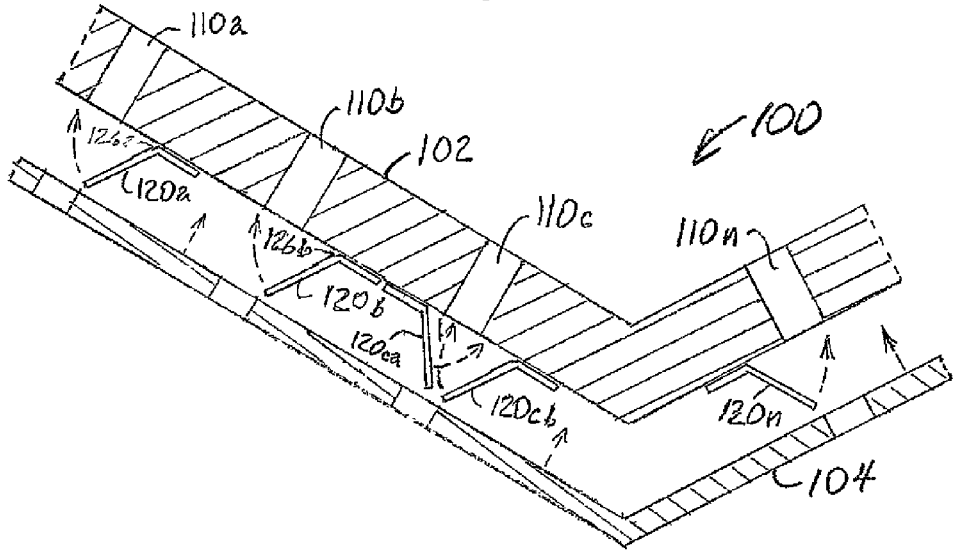
FIG. 4 is a sectional view of another embodiment of an armor structure of the present invention.

Referring to FIG. 4, a sectional view another embodiment of the armor system 100 is illustrated. The armor 100 may further comprise a plurality of valves (e.g., flaps, tabs, and the like) 120 (e.g., tab valves 120*a*-120*n*) having a bendable hinge 126 (e.g., hinges 126*a* and 126*b*). See, for example, U.S. Pat. No. 6,557,929, tabs 26 on FIGS. 2-24; and U.S. Pat. No. 7,350,451, projections 510 on FIGS. 6A and 6B. The bendable hinge 126 of the tabs 120 are generally fastened on the side of the inner plate 102 that faces the outer plate 104. Each of the tab valves 120*a*-120*n* are generally positioned and aligned with respect to complementary first openings 110*a*-110*n* (e.g., tab 120*a* at opening 110*a*, tab 120*b* at opening 110*b*, tabs 120*ca* and 120*cb* at opening 110*c*, and so forth) such that, when a blast event is encountered, in response to the blast event the outer plate 104 will push against the tab valve 120, the hinge 126 will bend, and the tab valve 120 will "weld" (flatten) against the inner plate 102 and block the opening 110 (i.e., the hinged flaps 120 perform as closing valves). The first openings 110 are blocked by the tab valves 120 such that there is no longer fluid communication through the openings 110 in the inner plate 102 (i.e., the ends of the openings 110 that face the outer plate 104 are generally blocked). One or more of the tab valves 120 are generally implemented per each of the first openings 110 (i.e., the number of valves 120 may be at least equal to the number of first openings 110). As such, blast protection is generally provided to the region of the vehicle 200 that is above the plate 102.

Figure 5:
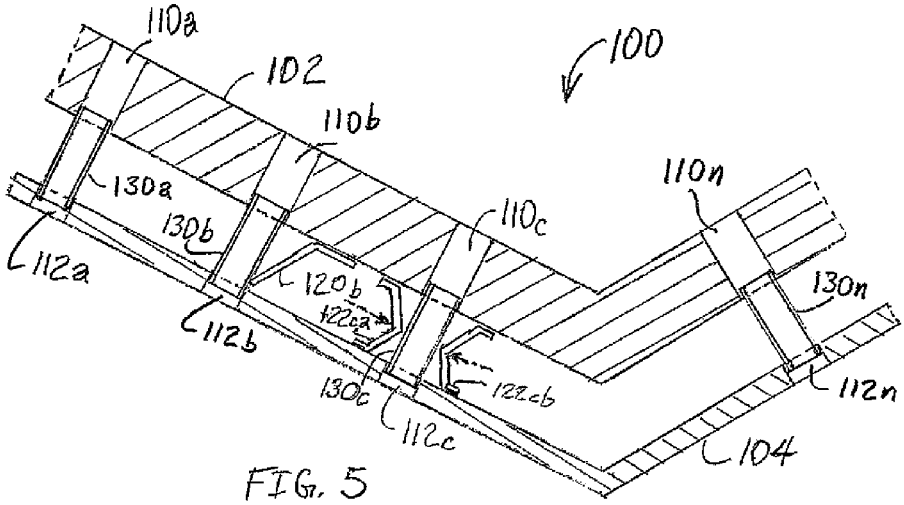
FIG. 5 is a sectional view of another embodiment of an armor structure of the present invention.

Referring to FIG. 5, a sectional view another embodiment of the armor system 100 is illustrated. The armor 100 may further comprise a plurality of ducts (i.e., tube, pipe, cylinder, and the like) 130 (e.g., ducts 130*a*-130*n*) each duct 130 having a first end and a second end. The duct 130 may be implemented to connect the complementary perforations 110 and 112 in the inner plate 102 and the outer plate 104, respectively, of the armor structure 100. That is, the first end of the duct 130*a* is generally inserted into the first opening 110*a* and fastened to the inner plate 102, and the second end of the duct 130*a* is generally inserted into the second opening 112*a* and fastened to the outer plate 104, and so on. The duct 130 may also reduce or prevent debris such as soil or mud from becoming lodged between the inner plate 102 and the outer plate 104.

The duct 130 is generally longer than the spacing, S, such that there is overlap into the openings 110 and 112, and the duct 130 is generally sized to snugly fit into the openings 110 and 112 and remain in place during normal vehicle 200 operations. The walls of the tube 130 are generally made of a thin, flexible material (e.g., steel, aluminum, plastic, etc.) that will generally collapse (e.g., pinch, fold, crush, crumple, etc.) when a blast event is encountered such that fluid communication via the opening 110 is reduced or prevented.

The tab valves 120 may be advantageously implemented in connection with complementary ducts 130. For example, the tab valve 120*b* is illustrated in connection with the duct 130*b*. When an underbody blast event is encountered by the vehicle 200, the tab valve 120 generally operates (e.g., bends at the hinge 126 region) to close (i.e., crush, pinch, block, etc.) the duct 130.

Further, one or more accordion (i.e., zigzag, saw-tooth, and the like) shaped valves 122 may be implemented in connection with complementary openings 110 and 112 and/or ducts 130 (e.g., accordion valves 122*ca* and 122*cb* that are implemented in connection with the openings 110*c* and 112*c* and the duct 130*c*). See, for example, U.S. Pat. No. 7,270,045, on FIGS. 1 and 2, element 156, for an accordion shaped element as implemented via the accordion valves 122. The accordion valves 122 are generally hinged, and are shaped and positioned (e.g., having at least one hinge apex substantially near a complementary opening 110, opening 112, and/or duct 130) such that, when an underbody blast event is encountered by the vehicle 200, the fluid communication between the complementary openings 110 and 112 is reduced or blocked; and when implemented in connection with the complementary duct 130, the duct 130 is pinched.

Figure 6:
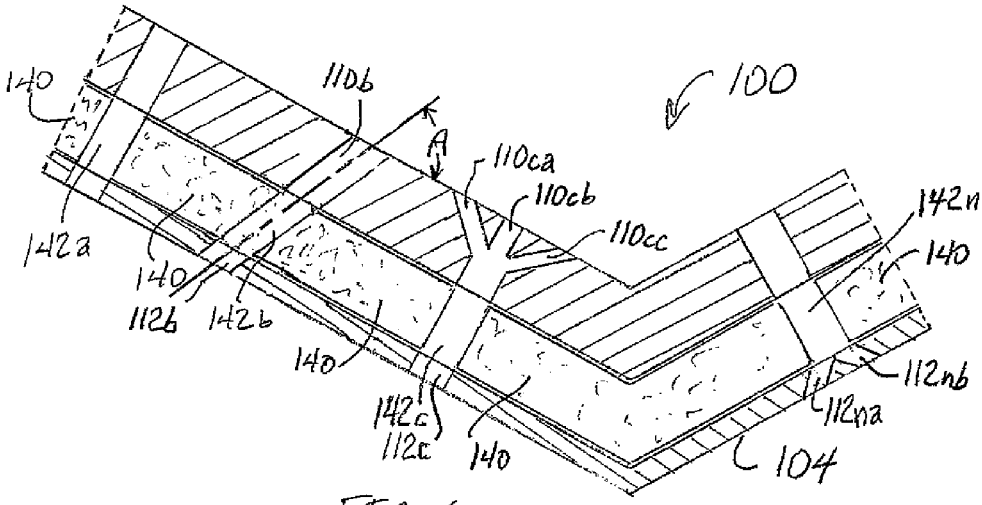
FIG. 6 is a sectional view of another embodiment of an armor structure of the present invention.

Referring to FIG. 6, a sectional view another embodiment of the armor system 100 is illustrated. The armor 100 may further comprise a filling 140 in the space between the inner and outer "V" plate structures 102 and 104, respectively. The filling 140 may be implemented as honeycomb, structural foam, or similar material (e.g., urethane foam). The filling 140 generally includes a plurality of complementary, continuous passages (i.e., ducts, lumens, holes, tunnels, etc.) 142 (e.g., passages 142*a*-142*n*) between the inner and outer perforations, 110*a*-110*n* and 112*a*-112*n*, respectively.

The duct 142 will generally conduct gasses efficiently from the inside of the inner "V" (i.e., above the plate 102) to the bottom of the outer "V" (i.e., below the plate 104). The filling 140 is generally compressible or crushable, and during a blast event, the filling 140 will generally not interfere with the closing of the openings 110. The filling 140 that is compressed or crushed during a blast event may aid the closing of the opening 110.

The filling 140 may also reduce or prevent debris such as soil or mud from becoming lodged between the inner plate 102 and the outer plate 104. Buildup of such debris would generally add weight to the vehicle and could result in preventing the valves 120 and/or 122 from functioning properly.

Further, as illustrated on FIG. 6, the openings 110 and 122, and the passage 142, may be implemented at an angle, A, where the angle, A, is not necessarily perpendicular to the planar surfaces of the plates 102 and 104.

Yet further illustrated in connection with FIG. 6, a plurality of the openings 110 and 112 may be combined (e.g., interconnected, merged, "siamesed", and the like) to provide fluid communication through the respective plate 102 or 104, or the passage 142. For example, the openings 110*ca*-110*cc* may combine to provide fluid communication through the inner plate 102 and into the passage 142*c*. Similarly, the passage 142*n* may provide fluid communication into the combined openings 112*na* and 112*nb* in the outer plate 104.

One or more of the elements of the embodiments of the armor 100 may be advantageously combined. For example, the valves 120 and 122 as described in connection with FIGS. 4 and 5, alone or in combination, may also be implemented in connection with the filling 140 and the passages 142 described in connection with FIG. 6. When the valves 120 and/or 122 are combined with the filling 140 and the passages 142, the filling 140 will generally not interfere with the closing operation of the valve mechanism 120 and/or 122. The number of valves 120 and/or 122 is generally at least equal to the number of the first openings 110.

In another example, the duct 130 of FIG. 5 may be implemented in connection with the filling 140 of FIG. 6. In particular, the filling 140 may be implemented in the spacing between the inner and outer "V" plate structures 102 and 104, exclusive of inside of the duct 130 such that the heat dissipative effect of the duct 130 is maintained.

As is apparent then from the above detailed description, the present invention may provide an improved system and an improved method for a vented, V shaped armor (e.g., the armor 100).

Various alterations and modifications will become apparent to those skilled in the art without departing from the scope and spirit of this invention and it is understood this invention is limited only by the following claims.

What is claimed is:

1. An armor structure for a vehicle underbody, the armor structure comprising:

an inner plate that is mounted proximate to the vehicle underbody, the inner plate having a plurality of first openings; and an outer plate that is mounted distal to the vehicle underbody, the outer plate having a plurality of second openings, wherein the inner plate and the outer plate are substantially parallel and separated by a spacing;

the inner plate and the outer plate each have substantially equal V bends at an obtuse angle, and the V bends in the inner plate and the outer plate are aligned;

the first openings and the second openings are (i) aligned across the spacing from each other, and (ii) substantially equal in area; wherein, the first openings and the second openings provide fluid communication through the armor structure; and a plurality of ducts equal to the number of first openings and made of a flexible material, each duct connecting one of the first openings with one of the second openings, across the spacing, such that each duct is aligned with one of the first openings and one of the second openings, wherein the ducts are longer than the spacing such that there is overlap into the first openings and the second openings and the ducts are sized to fit into the first openings and the second openings; wherein, when an underbody blast event is encountered by the vehicle underbody, the outer plate is forced towards, and substantially against the inner plate such that the first and second openings are no longer aligned, and the walls of the ducts will collapse when the underbody blast event is encountered such that fluid communication via the each of the first openings is reduced or prevented.

2. The armor structure of claim 1, wherein the inner plate is thicker than the outer plate.

3. The armor structure of claim 2, wherein the inner plate is at least twice as thick as the outer plate.

4. The armor structure of claim 2, wherein the inner plate is at least five times as thick as the outer plate.

5. The armor structure of claim 1, wherein the armor structure further comprises:

a filling in the spacing exclusive of inside of the ducts; and the filling is compressible or crushable, and during the underbody blast event, the filling is compressed or crushed.

6. The armor structure of claim 1, wherein the armor structure further comprises:

a plurality of valves, each valve having a bendable hinge, the bendable hinge fastened on the side of the inner plate that faces the outer plate; and each of the valves is positioned and aligned with respect to one of the ducts such that, when the underbody blast event is encountered, the outer plate will push against the valve, the hinge will bend, and the valve will block the duct such that there is no longer fluid communication through the first opening.

7. The armor structure of claim 6, wherein the valves are implemented as at least one of a tab valve and an accordion valve.

8. A method of protecting a vehicle underbody, the method comprising:

mounting an inner plate proximate to the vehicle underbody, the inner plate having a plurality of first openings; and mounting an outer plate distal to the vehicle underbody, the outer plate having a plurality of second openings, to form an armor structure, wherein the inner plate and the outer plate are substantially parallel and separated by a spacing;

the inner plate and the outer plate each have substantially equal V bends at an obtuse angle, and the V bends in the inner plate and the outer plate are aligned;

the first openings and the second openings are (i) aligned across the spacing from each other, and (ii) substantially equal in area; wherein, the first openings and the second openings provide fluid communication through the armor structure; and a plurality of ducts equal to the number of first openings and made of a flexible material, each duct connecting one of the first openings with one of the second openings, across the spacing, such that each duct is aligned with one of the first openings and one of the second openings, wherein the ducts are longer than the spacing such that there is overlap into the first openings and the second openings and the ducts are sized to fit into the first openings and the second openings; wherein, when an underbody blast event is encountered by the vehicle underbody, the outer plate is forced towards, and substantially against the inner plate such that the first and second openings are no longer aligned, and the walls of the ducts will collapse when the underbody blast event is encountered such that the fluid communication via the each of the first openings is reduced or prevented.

9. The method of claim 8, wherein the inner plate is thicker than the outer plate.

10. The method of claim 9, wherein the inner plate is at least twice as thick as the outer plate.

11. The method of claim 9, wherein the inner plate is at least five times as thick as the outer plate.

12. The method of claim 8, wherein the armor structure further comprises:

a filling in the spacing exclusive of inside of the ducts; and the filling is compressible or crushable, and during the underbody blast event, the filling is compressed or crushed.

13. The method of claim 8, wherein the armor structure further comprises:

a plurality of valves, each valve having a bendable hinge, the bendable hinge fastened on the side of the inner plate that faces the outer plate; and each of the valves is positioned and aligned with respect to one of the ducts such that, when the underbody blast event is encountered, the outer plate will push against the valve, the hinge will bend, and the valve win block the duct such that there is no longer fluid communication through the first opening.

14. The method of claim 13, wherein the valves are implemented as at least one of a tab valve and an accordion valve.

* * * * *